US005914913A

United States Patent [19]

Shriqui

[11] Patent Number: 5,914,913

[45] Date of Patent: Jun. 22, 1999

[54] INTERCHANGEABLE WATCHBAND AND WATCHCASE ATTACHMENT ASSEMBLY

[76] Inventor: David M. Shriqui, 392 Fifth Ave., Suite 711, New York, N.Y. 10018

[21] Appl. No.: 08/975,464

[22] Filed: Nov. 21, 1997

[51] Int. Cl.[6] ..... G04B 37/00; A44C 5/14

[52] U.S. Cl. ..... 368/282; 224/164

[58] Field of Search ..... 368/281, 282; 24/265 B, 265 WS; 224/164, 167

[56] References Cited

U.S. PATENT DOCUMENTS

| | | | |
|---|---|---|---|
| 2,990,628 | 7/1961 | Comte | 24/265 WS |
| 5,398,218 | 3/1995 | Munnier et al. | 368/282 |
| 5,416,953 | 5/1995 | Hui | 368/282 |

*Primary Examiner*—Vit Miska
*Attorney, Agent, or Firm*—Ezra Sutton

[57] ABSTRACT

An interchangeable attachment assembly for a wristwatch having a removable and interchangeable watchband and watchcasing. The interchangeable attachment assembly includes a watchcasing having a housing with first and second attachment modules that include first and second pairs of attachment pin assemblies located on opposite sides of the housing. The interchangeable attachment assembly further includes a watchband having first and second ends with first and second attachment members, respectively, for removably attaching the watchband to the first and second pairs of attachment pin assemblies, respectively, of the watch casing. An alternate embodiment discloses the attachment assembly for removably connecting a bracelet to a jewelry attachment, such as a setting for a gem stone.

16 Claims, 4 Drawing Sheets

INTERCHANGEABLE WATCHBAND AND WATCHCASE ATTACHMENT ASSEMBLY

FIELD OF THE INVENTION

This invention relates to a wristwatch with a removable and interchangeable watchband strap and/or watchcasing. More particularly, each watchband strap and each watchcasing has an interchangeable attachment assembly for easily interchanging a particular watchband to a particular watchcasing.

BACKGROUND OF THE INVENTION

The wristwatch fashion trend of today is to have watchband straps interchangeable with different wristwatch styles of a particular watchcasing. The watchband may be made of leather, plastic, fabric or metal and may have various fastening means, such as two connecting members fastened to lugs of a watch case housing through the use of fastening pins.

There remains a need for an interchangeable watchband and watchcase attachment assembly that is easy and simple to use, durable, and of an aesthetic design to match a particular type of watchband to a particular style of watchcasing for a fashionable appearance.

DESCRIPTION OF THE PRIOR ART

Watchband and watchcasing attachment assemblies having various designs, structures and configurations have been disclosed in the prior art. For example, U.S. Pat. No. 5,065,376 to Choulet discloses a wristband casing with a removable and interchangeable strap. The wristwatch includes a strap having a recessed opening which forms a housing for the watch casing and the ring fastener. The watch casing includes tabs having notches which co-operate with the receiving sleeves of the ring fastener. This prior art patent does not disclose or teach the particular structure of the watchband and watchcase attachment assembly of the present invention.

U.S. Pat. No. 4,862,435 to Reichel et al discloses a combination bracelet and wristwatch. The watchcase is attached to the chain bracelet by a rotatable and pivotable universal connector. The universal connector includes a central collar, a spindle portion, and a connecting link having a pair of connecting ends. The central collar includes a pair of diametrically opposed hole openings which receive the connecting ends of the connecting link for attaching the chain bracelet to the watchcase. This prior art patent does not disclose or teach the particular structure of the watchband and watchcase attachment assembly of the present invention.

U.S. Pat. No. 5,331,610 to Kikuchi discloses a structure for connecting a band to a watchcase. The watchcase includes a pair of ornamental lugs, a pair of band connecting lugs, and band connecting projections which interfit with the band connecting lugs and the ornamental lugs via a connecting pin. Each of the ornamental and band connecting lugs and the connecting projections have hole openings, respectively, for receiving the connecting pin for the attachment of the watchband to the bezel of the watchcasing. This prior art patent does not disclose or teach the particular structure of the watchband and watchcase attachment assembly of the present invention.

None of the aforementioned prior art patents teach or disclose the structure or configuration of the watchband and watchcase attachment assembly of the present invention having an operational mechanism which is simple in mechanical design for quickly and easily interchanging different watchbands with different watchcasings by a user.

Accordingly, it is an object of the present invention to provide an interchangeable watchband and watchcase attachment assembly of a simple design, such that the user can easily and quickly interchange different styles of watchbands to different styles of watchcasings.

Another object of the present invention is to provide an interchangeable watchband and watchcase attachment assembly that is durable and long-lasting in which the attachment pins removably attach the watchcasing to a watchband.

Another object of the present invention is to provide an interchangeable watchband and watchcase attachment assembly that has an aesthetically pleasing design to match a particular type of watchband to a particular style of watchcasing to provide a fashionable appearance, and where the user can choose from many types and styles of watchbands to match with many types and styles of watchcasings.

Another object of the present invention is to provide an interchangeable watchband and watchcase attachment assembly for watchbands made of leather, plastic, fabric or metal for women's and men's styles.

Another object of the present invention is to provide an interchangeable watchband and watchcase attachment assembly where the watchcasing may be of any style, such as dress, casual, or sports for women's and men's styles.

A further object of the present invention is to provide an interchangeable watchband and watchcase attachment assembly that can be mass produced in an automated and economical manner, that is easy to use by the wearer, and is readily affordable by the consumer.

SUMMARY OF THE INVENTION

In accordance with the present invention, there is provided an interchangeable attachment assembly for a wristwatch having a removable and interchangeable watchband and watch casing. The interchangeable attachment assembly includes a watch casing having a housing with first and second attachment modules that include first and second pairs of attachment pin assembles located on opposite sides of the housing. The interchangeable attachment assembly further includes a watchband having first and second ends with first and second attachment members, respectively, for removably attaching the watchband to the first and second pairs of attachment pins assemblies.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
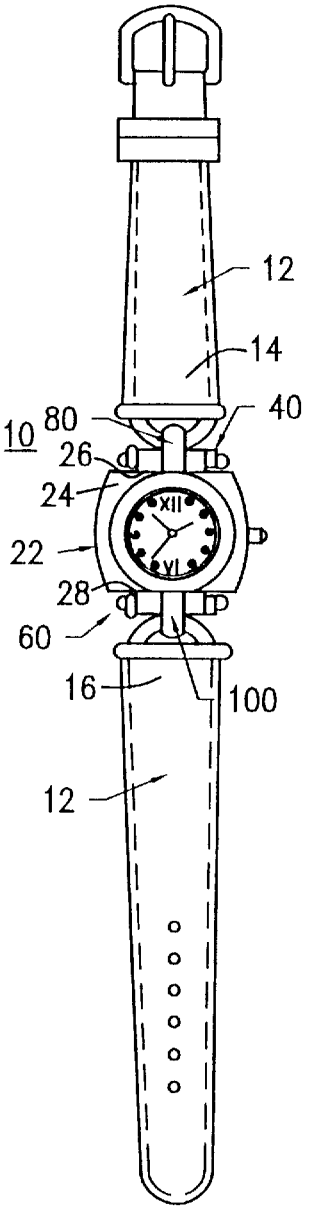
FIG. 1 is a front view of the interchangeable attachment assembly of the preferred embodiment of the present invention showing a first style of watchband and watchcasing using the interchangeable attachment assembly, and being in an assembled configuration.

An interchangeable attachment assembly 10 and its component parts, for interchanging different styles of watchbands 12 with different styles of watchcasings 22, of the preferred embodiment of the present invention are represented in detail by FIGS. 1 through 8. The interchangeable attachment assembly 10, as shown in FIGS. 1 to 4A of the drawings, includes first and second attachment modules 40 and 60, each being located and connected to opposite sides 26 and 28 of housing 24 of watchcasing 22. Attachment assembly 10 further includes first and second attachment members 80 and 100, each being connected and attached to first and second ends 14 and 16, respectively, of watchband 12.

Figure 4A:
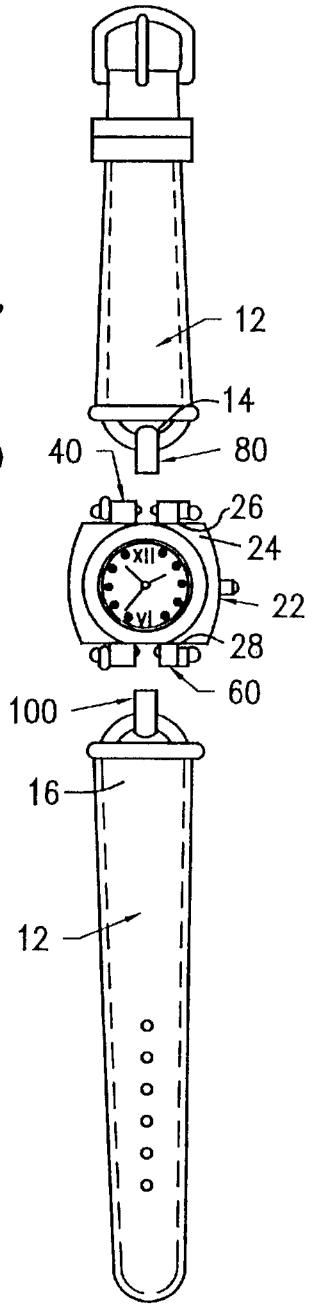
FIG. 4A is a front exploded view of the interchangeable attachment assembly of the present invention showing the watchcasing being attached to the watchband strap with the interchangeable attachment assembly of the present invention.
Figure 4:
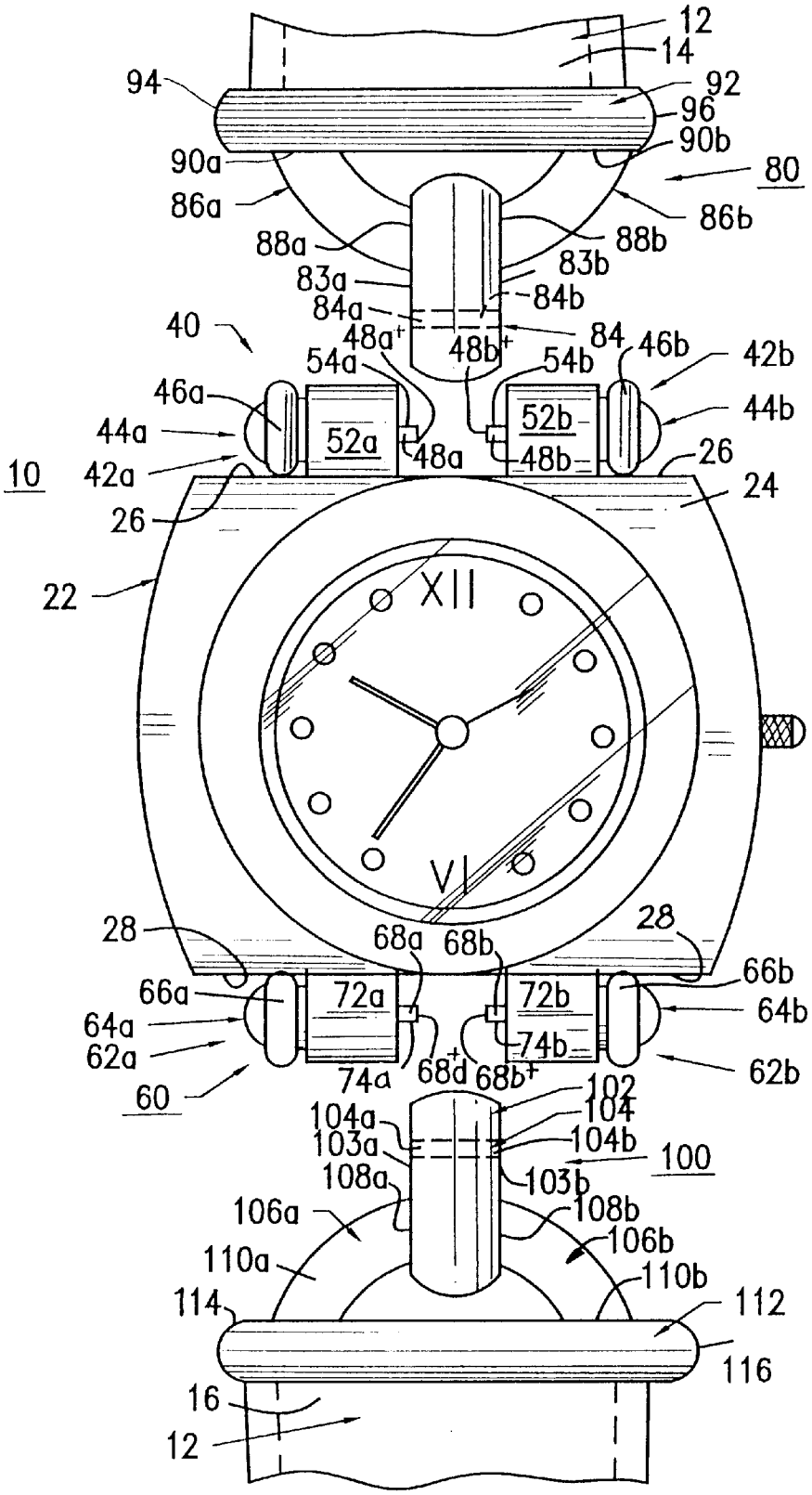
FIG. 4 is an enlarged exploded front view of the interchangeable attachment assembly of the present invention showing the first and second attachment modules and their component parts contained therein being attached to the housing of the watchcasing, and the first and second attachment members and their component parts contained thereon being attached to the first and second ends of the watchband strap.
Figure 5:
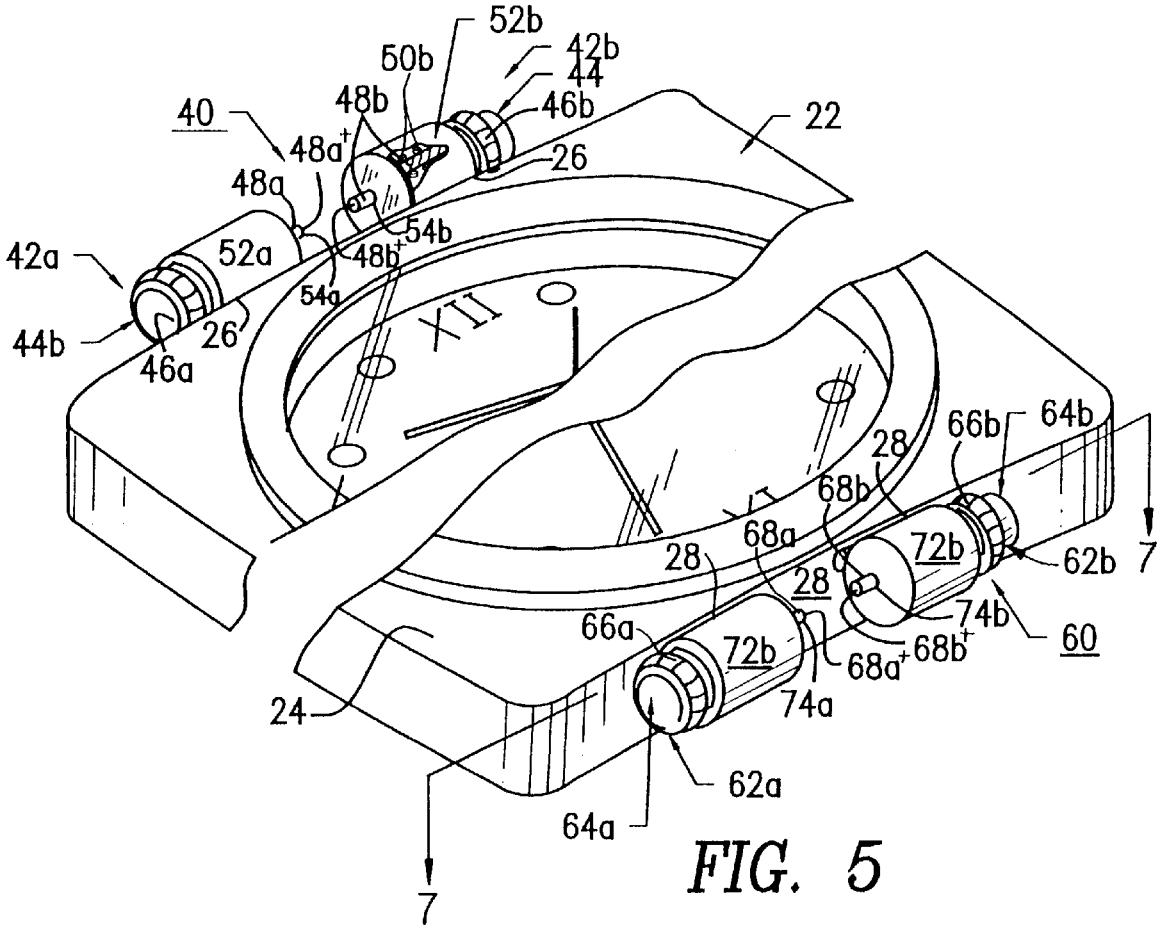
FIG. 5 is an enlarged front perspective view of the interchangeable attachment assembly of the present invention showing the first and second attachment modules and their component parts contained therein being attached to the housing of the watchcasing.
Figure 7:
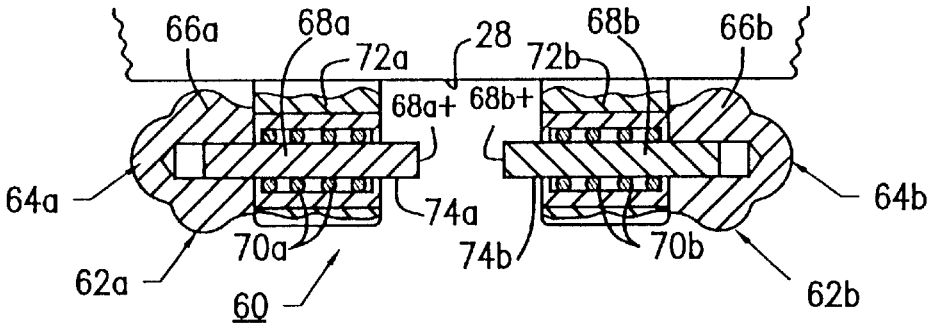
FIG. 7 is an enlarged cross-sectional view of the interchangeable attachment assembly of the present invention taken along lines 7—7 of FIG. 5 showing the second attachment module and its component parts contained therein.

First attachment module 40, as shown in FIGS. 4 and 5 of the drawings, includes a first pair of attachment pin assemblies 42*a* and 42*b* having a first pair of attachment lugs 52*a* and 52*b*. Each of the attachment pin assemblies 42*a* and 42*b* include attachment pins 44*a* and 44*b* having pull tabs/pull knobs 46*a* and 46*b* attached to pin shafts 48*a* and 48*b*, respectively. Each attachment pin shaft 48*a* and 48*b* also includes retention springs 50*a* and 50*b* thereon, for moving the attachment pins 44*a* and 44*b* to their most inward positions as shown in FIGS. 4 and 5 of the drawings. Each of the attachment lugs 52*a* and 52*b* includes hole openings 54*a* and 54*b* for receipt of attachment pin shafts 4*a* and 4*b* and retention springs 50*a* and 50*b*, respectively, therein. First attachment module 40 is attached to the top side wall 26 of housing 24 of watchcasing 22.

Second attachment module 60, as shown in FIGS. 4 and 5 of the drawings, includes a second pair of attachment pin assemblies 62*a* and 62*b* having a second pair of attachment lugs 72*a* and 72*b*. Each of the attachment pin assemblies 62*a* and 62*b* include attachment pins 64*a* and 64*b* having pull tabs/pull knobs 66*a* and 66*b* attached to pin shafts 68*a* and 68*b*, respectively. Each attachment pin shaft 68*a* and 68*b* also includes retention springs 70*a* and 70*b* thereon, for moving the attachment pins 64*a* and 64*b* to their most inward position, as shown in FIGS. 4 and 5 of the drawings. Each of the attachment lugs 72*a* and 72*b* includes hole openings 74*a* and 74*b* for receipt of attachment pin shafts 68*a* and 68*b* and retention springs 70*a* and 70*b*, respectively, therein. Second attachment module 60 is attached to the bottom side wall 28 of housing 24 of watchcasing 22.

Figure 6:
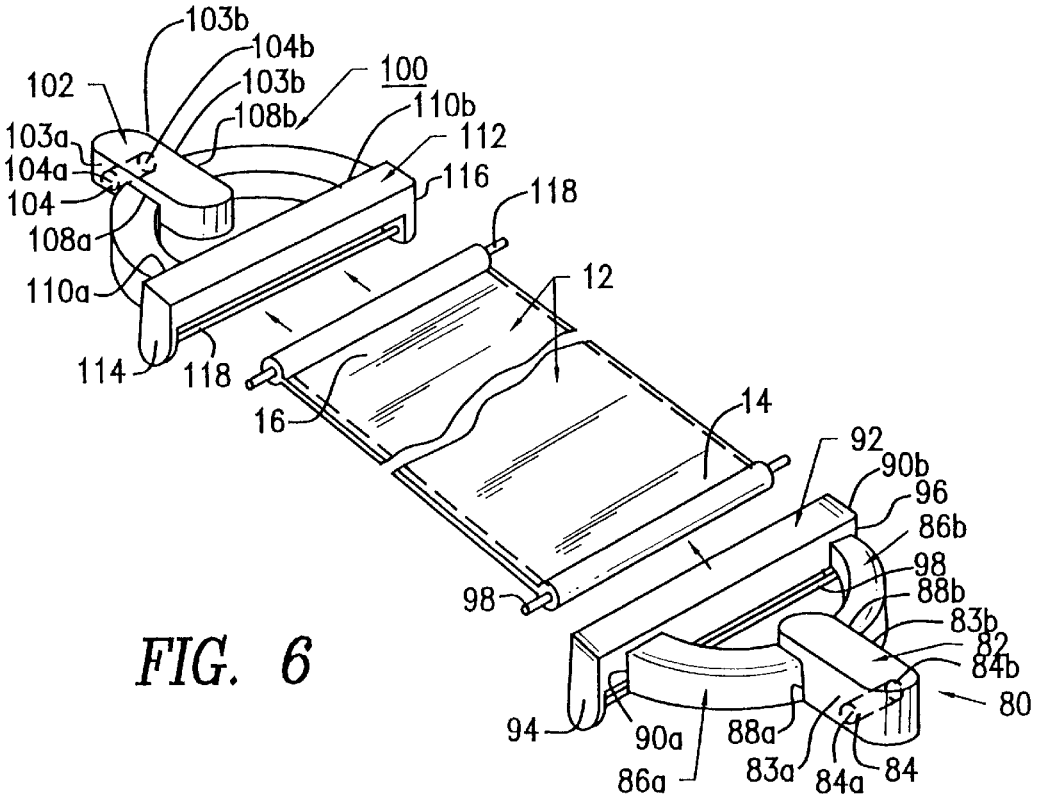
FIG. 6 is an enlarged front perspective view of the interchangeable attachment assembly of the present invention showing the first and second attachment members and their component parts contained thereon in relationship to the first and second ends of the watchband attachment.
Figure 8:
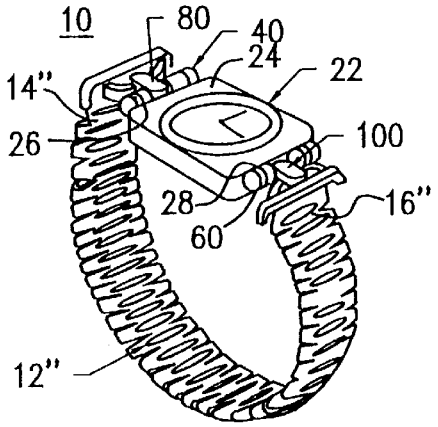
FIG. 8 is a front perspective view of the interchangeable attachment assembly of the present invention showing a fourth style using an expandable watchband attached to the watchcasing of FIG. 1 with the interchangeable attachment assembly and being in an assembled configuration.

First attachment member 80, as shown in FIGS. 4A, 4 and 6 of the drawings includes a central connecting bar 82 having an opening 84 formed therein, a pair of connecting members 86*a* and 86*b* each being attached at one end 88*a* and 88*b* to the connecting bar 82. First attachment member 80 further includes a band retaining member 92 having integrally connected side walls 94 and 96 for holding a retaining bar 98 therebetween. Retaining bar 98 is used for holding the first end 14 of watchband 12 in place. The other ends 90*a* and 90*b* of connecting members 86*a* and 86*b* are connected to band retaining member 92.

The pin shaft tips 48*at* and 48*bt* interfit with and snap into the hole openings 84*a* and 84*b* on each side 83*a* and 83*b* of the connecting bar 82, such that the first attachment module 40 is removably connected to the first attachment member 80 so as to remove or connect the first end 14 of watchband 12 to the top side 26 of housing 24 of watchcasing 22, as shown in FIGS. 1, 2, 3 and 4A of the drawings.

Second attachment member 100, as shown in FIGS. 4A, 4 and 6 of the drawings, includes a central connecting bar 102 having an opening formed therein 104, a pair of connecting members 106*a* and 106*b* each being attached at each of one end 108*a* and 108*b* to the connecting bar 102. Second attachment member 100 further includes a band retaining member 112 having integrally connected side walls 114 and 116 for holding a retaining bar 118 therebetween. Retaining bar 118 is used for holding the second end 16 of watchband 12 in place. The other ends 110*a* and 110*b* of connecting members 106*a* and 106*b* are connected to band retaining member 112.

The pin shaft tips 68*at* and 68*bt* interfit with and snap into the hole openings 104*a* and 104*b* on each side 103*a* and 103*b* of the connecting bar 102, such that the second attachment module 60 is removably connected to the second attachment member 100 so as to remove or connect the second end 16 of watchband 12 to the bottom side 28 of housing 24 of watch casing 22, as shown in FIGS. 1, 2, 3 and 4A of the drawings.

DETAILED DESCRIPTION OF THE ALTERNATE EMBODIMENT

Figure 9:
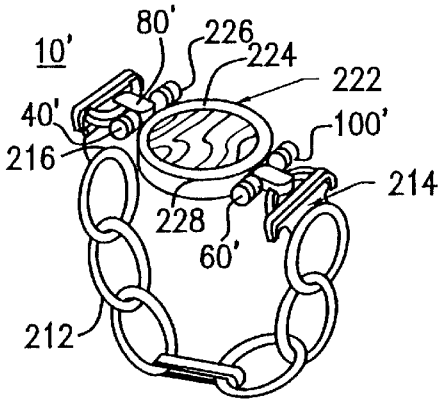
FIG. 9 is a front perspective view of the interchangeable assembly of the alternate embodiment of the present invention showing a jewelry bracelet having a linked bracelet band attached to a detachable jewelry attachment via the interchangeable attachment assembly, and being in an assembled configuration.

An alternate embodiment of an interchangeable attachment assembly 10' and its component parts, for interchanging different styles of jewelry bands or bracelets 212 with different styles of jewelry attachments 222 is represented in detail by FIG. 9 of the drawings. The interchangeable attachment assembly 10', as shown in FIG. 9, includes first and second attachment modules 40' and 60', each being located and connected to opposite sides 226 and 228 of housing 224 of the jewelry attachment 222. Attachment assembly 10' further includes first and second attachment members and 80' and 100', each being connected and attached to first and second ends 214 and 216, respectively, of jewelry band or bracelet 212. In all other respects, the interchangeable attachment assembly 10' of the alternate embodiment is exactly the same as the interchangeable attachment assembly 10 of the preferred embodiment.

Jewelry attachment 222 may include a stone and its setting or any other type of jewelry worn as part of a bracelet or connected to a bracelet.

OPERATION OF THE PRESENT INVENTION

Figure 2:
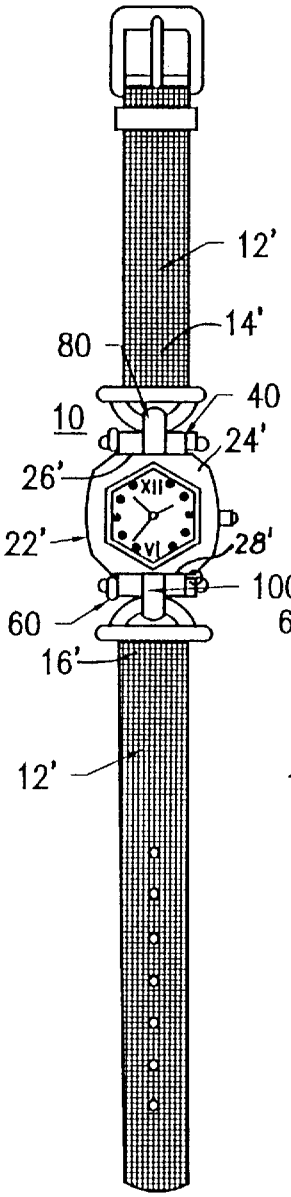
FIG. 2 is a front view of the interchangeable attachment assembly of the preferred embodiment of the present invention showing a second style of watchband and watchcasing using the interchangeable attachment assembly, and being in an assembled configuration.
Figure 3:
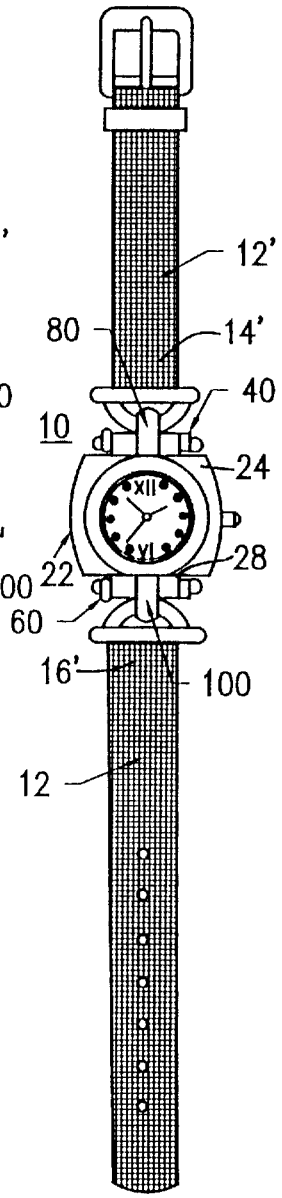
FIG. 3 is a front view of the interchangeable attachment assembly of the preferred embodiment of the present invention showing a third style by using a watchband of FIG. 2 attached to the watchcasing of FIG. 1 via the interchangeable attachment assembly, and being in an assembled configuration.

In operation, the user first chooses a particular style of watchband 12 or 12' to use with a particular style of watchcasing 22 or 22', as shown in FIGS. 1 to 3 of the drawings. This match of a watchband 12 to a watchcasing 22, as shown in FIG. 1 of the drawings, may give the wearer an aesthetic fashion presentation of a casual wristwatch, a dress wristwatch, etc. depending upon the actual watchband type and watchcasing type selected by the wearer.

To fit a particular watchband 12 to a watchcasing 22, the wearer interfits or engages the hole openings 84*a* and 84*b* on each side 83*a* and 83*b* of the connecting bar 82 of the first attachment member 80 with the pin shaft tips 48*at* and 48*bt* of the attachment pins 44*a* and 44*b* to snap them in place. This above step is achieved when the wearer pulls the pull knobs 46*a* and 46*b* outwardly in which the retention springs 50*a* and 50*b* are compressed within the lugs 52*a* and 52*b,* respectively, which moves the pin shaft tips 48*at* and 48*bt* literally so they are recessed within the lugs 52*a* and 52*b,* respectively. The wearer then aligns the pin shaft tips 48*at* and 48*bt* with the hole openings 84*a* and 84*b* of central connecting bar 82, and then the wearer releases the pin shaft tips 48*at* and 48*bt* into the hole openings 84*a* and 84*b,* thereby releasing the spring tension of retention springs 50*a* and 50*b* within the lugs 52*a* and 52*b.* This locks the attachment pins 44*a* and 44*b* to the connecting bar 82, such that the first attachment module 40 is connected to the first attachment member 80 which is connected to the first end 14 of watchband 12. First attachment module 40 is also connected to the top side 26 of housing 24 of watchcasing 22, as shown in FIGS. 1 and 4A of the drawings.

This aforementioned operation is repeated again by the wearer for the second end 16 of watchband 12. The wearer interfits or engages the hole openings 104*a* and 104*b* on each side 103*a* and 103*b* of the connecting bar 102 of the second attachment member 100 with the pin shaft tips 68*at* and 68*bt* of the attachment pins 64*a* and 64*b* to snap them in place. This above second step is achieved when the wearer pulls the pull knobs 66*a* and 66*b* outwardly so the retention springs 70*a* and 70*b* are compressed within the lugs 72*a* and 72*b,* respectively, which moves the pin shaft tips 68*at* and 68*bt* laterally so they are recessed within the lugs 72*a* and 72*b,* respectively. The wearer then aligns the pin shaft tips 68*at* and 68*bt* with the hole openings 104*a* and 104*b* of the connecting bar 102, and then the wearer releases the pin shaft tips 68*at* and 68*bt* into the hole openings 104*a* and 104*b,* thereby releasing the spring tension of retention springs 70*a* and 70*b* with the lugs 72*a* and 72*b.* This locks the attachment pins 64*a* and 64*b* to the connecting bar section 102, such that the second attachment module 60 is connected to the second attachment member 100 which is connected to the second end 16 of watchband 12. Second attachment module 60 is also connected to the bottom side 28 of housing 24 of watchcasing 22, as shown in FIGS. 1 and 4A of the drawings.

To change again to a different watchband 12' and connect it to the same watchcasing 22, the wearer simply reverses the above-mentioned steps, takes away watchband 12 and replaces it with watchband 12' using the same operational steps previously mentioned. The user can have an almost infinite variety of matched ensembles of watchbands and watchcasings using the interchangeable attachment assembly 10 of the present invention.

ADVANTAGES OF THE PRESENT INVENTION

Accordingly, an advantage of the present invention is that it provides for an interchangeable watchband and watchcase attachment assembly of a simple design, such that the user can easily and quickly interchange different styles of watchbands to different styles of watchcasings.

Another advantage of the present invention is that it provides for an interchangeable watchband and watchcase attachment assembly that is durable and long-lasting in which the attachment pins removably attach the watchcasing to a watchband.

Another advantage of the present invention is that it provides for an interchangeable watchband and watchcase attachment assembly that has an aesthetically pleasing design to match a particular type of watchband to a particular style of watchcasing to provide a fashionable appearance, and presentation where the user can choose from many types and styles of watchbands to match with many types and styles of watchcasings.

Another advantage of the present invention is that it provides for an interchangeable watchband and watchcase attachment assembly for watchbands made of leather, plastic, fabric or metal for women's and men's styles.

Another advantage of the present invention is that it provides for an interchangeable watchband and watchcase attachment assembly where the watchcasing may be of any style, such as dress, casual, or sports for women's and men's styles.

A further advantage of the present invention is that it provides for an interchangeable watchband and watchcase attachment assembly that can be mass produced in an automated and economical manner, that is easy to use by the wearer, and is readily affordable by the consumer.

A latitude of modification, change, and substitution is intended in the forgoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A watchcasing and watchband having an attachment assembly for interchanging the watchcasing or watchband with other watchcasings or watchbands, said attachment assembly comprising:

a) said watchcasing including a housing having first and second attachment modules connected to opposite sides of said housing, including first and second pairs of attachment pin assemblies located on opposite sides of said housing;

b) said watchband having first and second ends including first and second attachment members, respectively, for removably attaching said watchband to said first and second pairs of attachment pin assemblies, respectively, of said watch casing;

c) each of said first and second pairs of attachment pin assemblies include a pair of attachment pins and housings for providing double locking of said first and second pairs of attachment pins and housings in connecting with said first and second attachment members, of said watch casing; and d) each of said pairs of attachment pins and housings having a pull knob, an attachment pin, a retention spring surrounding said attachment pin, and an attachment housing for receiving said attachment pin and said retention spring therein for providing positive locking of said attachment pin within one of said first and second attachment modules.

2. A watchcasing and a watchband in accordance with claim 1, wherein each of said attachment pins includes a pin shaft and a pin tip.

3. A watchcasing and a watchband in accordance with claim 2, wherein first and second attachment members each include a connecting bar having an opening formed therein, a pair of connecting members attached to opposite sides of said connecting bar, a band retaining member having side walls, said side walls being connected to said pair of connecting members, and a watchband retaining bar connected to said side walls for receiving the end of a watchband.

4. A watchcasing and a watchband in accordance with claim 3, wherein each of said pin tips are received within said openings of said connecting bars.

5. A watchcasing and a watchband in accordance with claim 1, wherein said first and second attachment modules are made of plastic or metal.

6. A watchcasing and a watchband in accordance with claim 1, wherein said first and second attachment members are made of plastic or metal.

7. A watchcasing and a watchband in accordance with claim 1, wherein said watchband includes a pair of straps having a buckle and a tine.

8. A watchcasing and a watchband in accordance with claim 1, wherein said watchband is a single expandable band made of metal, plastic, leather, or fabric.

9. A jewelry attachment and bracelet having an attachment for interchanging the jewelry attachment or bracelet with other jewelry attachments or bracelets, said attachment assembly comprising:

a) said jewelry attachment including a housing having first and second attachment modules connected to opposite sides of said housing, including first and second pairs of attachment pin assemblies located on opposite sides of said housing;

b) said bracelet having first and second ends including first and second attachment members, respectively, for removably attaching said bracelet to said first and second pairs of attachment pin assemblies, respectively, of said jewelry attachment;

c) each of said first and second pairs of attachment pin assemblies include a pair of attachment pins and housings for providing double locking of said first and second pairs of attachment pins and housings in connecting with said first and second attachment members, of said watch casing; and d) each of said pairs of attachment pins and housings having a pull knob, an attachment pin, a retention spring surrounding said attachment pin, and an attachment housing for receiving said attachment pin and said retention spring therein for providing positive locking of said attachment pin within one of said first and second attachment modules.

10. A jewelry attachment and bracelet in accordance with claim 9, wherein each of said attachment pins includes a pin shaft and a pin tip.

11. A jewelry attachment and bracelet in accordance with claim 10, wherein first and second attachment members each include a connecting bar having an opening formed therein, a pair of connecting members attached to opposite sides of said connecting bar, a band retaining member having side walls, said side walls being connected to said pair of connecting members, and a watchband retaining bar connected to said side walls for receiving the end of a watchband.

12. A jewelry attachment and bracelet in accordance with claim 11, wherein each of said pin tips are received within said openings of said connecting bars.

13. A jewelry attachment and bracelet in accordance with claim 9, wherein said first and second attachment modules are made of plastic or metal.

14. A jewelry attachment and a bracelet in accordance with claim 9, wherein said first and second attachment members are made of plastic or metal.

15. A jewelry attachment and a bracelet in accordance with claim 11, wherein said bracelet is a link chain such as a single link chain, a double link chain or a multi-link chain, said link chain having said first and second ends connected to said retaining bars, for holding said first and second ends of said bracelet to said first and second attachment members.

16. A jewelry attachment and a bracelet in accordance with claim 9, wherein said bracelet is a single expandable band made of metal, plastic, leather, or fabric.

* * * * *